United States Patent [19]

Brammer et al.

[11] Patent Number: 4,529,850

[45] Date of Patent: Jul. 16, 1985

[54] IGNITION DISTRIBUTOR CAP

[75] Inventors: Hartmut Brammer, Vaihingen; Harry Kaiser, Markgröningen, both of Fed. Rep. of Germany

[73] Assignee: Robert Bosch GmbH, Stuttgart, Fed. Rep. of Germany

[21] Appl. No.: 631,096

[22] Filed: Jul. 16, 1984

[30] Foreign Application Priority Data

Aug. 17, 1983 [DE] Fed. Rep. of Germany ..... 3329647

[51] Int. Cl.[3] ..... F02P 7/00; H01H 19/00

[52] U.S. Cl. ..... 200/19 DC; 123/146.5 A

[58] Field of Search ..... 200/19 R, 19 DC, 293, 200/302.1, 19 WG; 339/29, 217 S; 174/18, 74 R, 74 A, 77 R, 113 R, 186, 188, 211, 212; 123/146.5 A

[56] References Cited

U.S. PATENT DOCUMENTS 2,598,162 5/1952 Guiot ..... 200/19 DC
3,829,635 8/1974 Elwert et al. ..... 200/19 DC X
4,177,365 12/1979 Blackman ..... 200/302.1 X
4,338,895 7/1982 Lennis et al. ..... 123/146.5 A

FOREIGN PATENT DOCUMENTS 892530 10/1953 Fed. Rep. of Germany ..... 200/19 DC

*Primary Examiner*—J. R. Scott
*Attorney, Agent, or Firm*—Frishauf, Holtz, Goodman & Woodward

[57] ABSTRACT

The high-voltage breakdown strength of the cap, and particularly of the cap portions between adjacent cap towers (4–8), is improved. The skirt (2) of the distributor cap defines an ignition distribution chamber which, in cross-section, is essentially square, with rounded corners. The outer surfaces of the cap are likewise essentially square with rounded corners. The cap towers merge smoothly into the upper end or cap portion of the cap, as well as into the skirt portion, so that no ridges or pockets are formed on the outside of the cap which might accumulate contaminants, impairing the high-voltage breakdown resistance of the cap.

8 Claims, 3 Drawing Figures

IGNITION DISTRIBUTOR CAP

The present invention relates to a distributor cap for an ignition distributor, for use with an externally ignited internal combustion engine, for example of the vehicular, or automotive type.

BACKGROUND

It has previously been proposed to provide an insulating cap for a distributor in which a circular internal space is defined by the cap, and in which high-voltage connecting towers are located adjacent the outer region of a roof surface of the cap. One such construction is shown, for example, in U. S. Pat. No. 4,338,895, Lennis and Handy. The cap has a circular internal chamber. The connecting towers extend from the outside and are continued in form of a ridge or bead which extends around the outer cap. The arrangement is so provided that there is sufficient clear space between the high-voltage connections of the electrodes, and the overall arrangement is designed to improve the high-voltage insulation between the electrodes, and electrode connections and connecting elements within the tower. The arrangement of the towers is suitable, although the bead which surrounds the towers on the top cover of the electrode tends to accumulate dust, dirt, and other contaminants, which detracts from resistance to spurious high-tension discharges, creep circuits and the like. When used in connection with an automobile engine, where the engine compartment is subjected to contamination by salt air, if used close to the ocean, or even salt spray, when passing, for example, through puddles of a previously salted road, contaminant may collect within the bead and further reduce resistance of the cap structure to leakage currents and the like.

THE INVENTION

It is an object to improve a distributor cap, particularly suitable for a four-cylinder internal combustion engine, which has excellent resistance to stray or sneak or leakage currents.

Briefly, the cap includes a skirt portion which defines therebetween an ignition distribution chamber. The skirt portion is so formed that, in transverse cross section, the distribution chamber is essentially square. It may have rounded corners, that is, approaching an irregular octagon, and four peripherally located cap towers are positioned at the corner of the essentially square skirt portion, and terminating adjacent the corner regions of the distributor chamber. The outer portion of the cap can then be molded to be completely smooth, with sloping, slanting side walls, without defining ridges, beads, or the like, so that any contaminating spray or liquid or deposits can easily run or drop off, without forming contaminating deposits along the cap.

DRAWINGS

DETAILED DESCRIPTION

Figure 1:
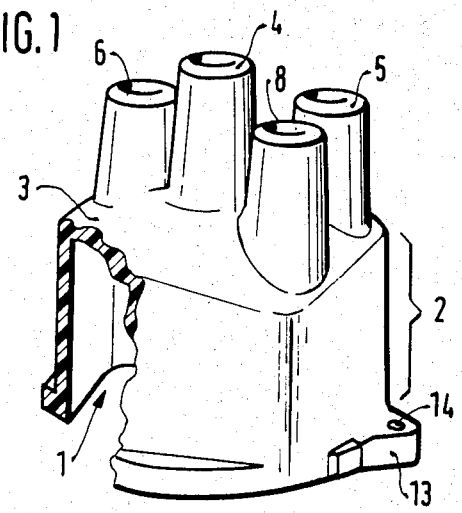
FIG. 1 is a general perspective view, partly broken away, of the cap in accordance with the present invention.

The cap is made of an insulating electrical material, for example polyester or the like, and is used to cover an ignition distributor unit of an electical ignition distributor for spark energy to spark plugs of an internal combustion engine. The insulating cap has a skirt portion 2 which defines therein an ignition distribution chamber 1. The roof or end or cap portion 3 of the cap has five cap towers 4, 5, 6, 7, 8, molded therein, which extend perpendicularly from the cap, that is, in a direction essentially parallel to the skirt portion 2. One of the cap towers is a center cap tower 4, for connection, for example, to the ignition coil of the internal combustion engine. In accordance with a feature of the invention, the cap towers 5–8 are located at the outer peripheral region of the cap or end portion 3, equidistantly from the center tower 4, and uniformly angularly distributed around the region of the end portion. The angular spacing between the cap towers 5–8 is identical. They are located close to the edge of the end portion of the distributor cap. The chamber 1, surrounded by the skirt 2 of the distributor cap, has essentially square shape in a transverse plane. The cap towers 5–8 located at the peripheral region of the end portion 3 are so arranged that they have an inner terminating opening, for connection of a distributor electrode element, which is positioned in the corner regions of the essentially square transverse shape of the chamber. This construction then results in an insulating cap which has surfaces which are smooth and without projections, ridges or ribs, both on the inside and on the outside. The size of the ignition distributor is standard for specific types of engines. The electrodes which extend into the ignition distributor chamber 1 will then be spaced from each other by a distance which is entirely sufficient, with an excellent margin of safety, to prevent sneak or creep current paths between the respective towers at the outside, or, respectively, the electrodes, including the electrode portions within the chamber. The distance between the electrodes, thus, can be so selected that greater distances than heretofore possible with prior constructions are available between the respective high-voltage electrodes. Openings 9 located within the towers provide for passage of electrical connection elements through the end cap portion 3 and to provide for electrical connection between the distributor electrode and an ignition cable inserted in the respective tower.

Figure 2:
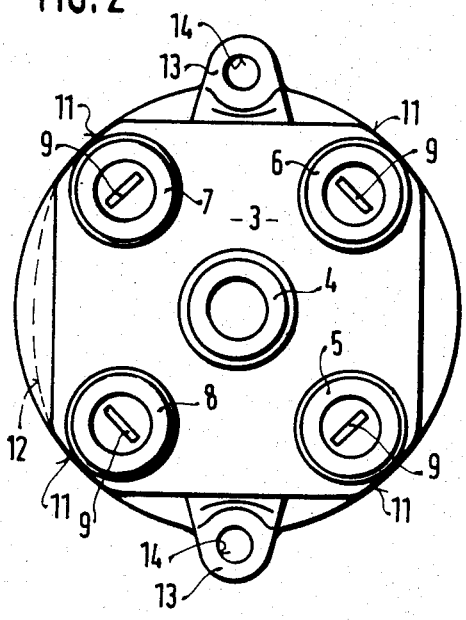
FIG. 2 is a top view of the cap.
Figure 3:
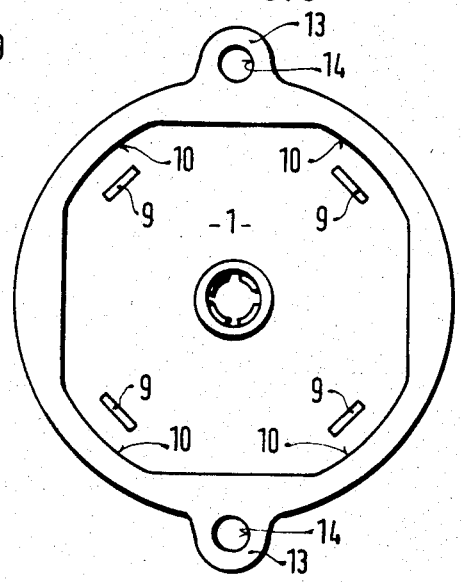
FIG. 3 is a bottom view, towards the inside of the cap.

High-voltage carrying capability is additionally enhanced by making the corner regions 10 either slightly rounded, or cutting the corners, as shown, for example, in FIG. 3. The outer region of the skirt portion 2 may also be formed essentially square, which results in a saving in material for the entire cap. To obtain good transition at the connection towers 5–8 with respect to the skirt portion, a bowed or curved portion along theoretical generating line 12 (FIG. 2), and extending between the corner regions 11, is desirable.

The insulating cap can be attached to a distributor by any well-known and suitable structure, for example by forming flange extensions 13 at diametrically opposite sides, in which attachment holes 14 are formed, so that the cap can be attached to a distributor housing by any suitable and well-known structure, such as screws or the like.

We claim:

1. A space-saving, voltage-breakdown-resistant ignition distributor cap, of insulating material, having a skirt portion (2) and a beadless upper end portion (3), five cap towers (4–8) projecting outwardly from the upper end portion, to provide for insulation of high-tension ignition cables insertable into the cap towers, wherein one (4) of the cap towers is centrally located and the other four cap towers (5–8) are peripherally located, equidistantly and uniformly angularly spaced from each other, wherein, in accordance with the invention, the skirt portion (2) defines an ignition distribution chamber (1) therein which, in transverse cross-section, is essentially square;

and wherein the four peripherally located cap towers terminate on the end portion (3) adjacent the corner regions (10) of the essentially square cross-section ignition distributor chamber (1).

2. Distributor cap according to claim 1, wherein the corner portions of the essentially square cross section of the ignition distribution chambers are cut or rounded to provide for essentially smooth transition between adjacent sides of the square defined by the essentially square cross section.

3. Distributor cap according to claim 1, wherein the outer circumference of the skirt portion (2) is essentially square.

4. Distributor cap according to claim 3, wherein the corner portions of the outer circumference of the skirt portion are rounded.

5. Distributor cap according to claim 3, wherein the skirt portion (2) in the region between corners (11) thereof, at the outside, is curved or bulged.

6. Distributor cap according to claim 3, wherein the corner portions (11) of the skirt portion are rounded, and provide for smooth transition of the outer surfaces of the skirt portion to the peripherally located cap towers and to the upper end or cap portion (3).

7. Distributor cap according to claim 1, wherein the outer surfaces defining the skirt portion (2), the upper end or cap portion (3) and the cap towers (4–8) all merge smoothly into each other, free from ridges or pockets, to prevent accumulation of contaminants reducing high-voltage breakdown strength of the cap.

8. A space-saving, voltage-breakdown-resistant-ignition distributor cap, of insulating material, having a skirt portion (2) and a upper end portion (3), five cap towers (4–8) projecting outwardly from the upper end portion, to provide for insulation of high-tension ignition cables insertable into the cap towers, and wherein, to prevent accumulation of contaminations which contribute to voltage breakdown between said cap towers, the outer surfaces defining the skirt portion (2), the upper end portion (3), and the cap towers (4–8) all merge smoothly into each other, free from ridges or beads; and wherein, to conserve space, four of said towers are peripherally located on said upper end portion, and terminate on the end portion (3) adjacent corner regions (10) of the end portion (3), and the skirt portion (2) closely surround said cap towers and defines an ignition distribution chamber (1) having an essentially square cross-sectional configuration.

* * * * *